US007814573B1

(12) United States Patent
Greenberg

(10) Patent No.: US 7,814,573 B1
(45) Date of Patent: Oct. 19, 2010

(54) SELF-SIZING CAP WITH DIVERSE HEADBAND SEGMENTS

(75) Inventor: Murray Greenberg, Somerset, NY (US)

(73) Assignee: Venus Knitting Mills, Inc., Murray Hill, NJ (US)

( * ) Notice: Subject to any disclaimer, the term of this patent is extended or adjusted under 35 U.S.C. 154(b) by 0 days.

(21) Appl. No.: 12/724,063

(22) Filed: Mar. 15, 2010

(51) Int. Cl.
*A42C 5/00* (2006.01)

(52) U.S. Cl. ..... 2/181

(58) Field of Classification Search ..... 2/181, 2/183, 195.3
See application file for complete search history.

(56) References Cited

U.S. PATENT DOCUMENTS

| | | | | |
|---|---|---|---|---|
| 3,309,713 | A | 3/1967 | Kaufman | |
| 4,608,721 | A | 9/1986 | Lipkin | |
| 4,662,007 | A | 5/1987 | Lipkin | |
| 5,715,540 | A | 2/1998 | Cho | |
| 5,966,742 | A * | 10/1999 | Cunliffe | 2/195.3 |
| 6,016,572 | A | 1/2000 | Park | |
| 6,067,658 | A | 5/2000 | Cho | |
| 6,336,224 | B1 * | 1/2002 | Wang | 2/195.3 |
| 6,339,844 | B1 * | 1/2002 | Merkley | 2/195.3 |
| 6,347,410 | B1 * | 2/2002 | Lee | 2/181 |
| 6,493,880 | B1 * | 12/2002 | Lo | 2/195.2 |
| 6,892,398 | B2 * | 5/2005 | Wilson | 2/181 |
| 2004/0003450 | A1 * | 1/2004 | Wang | 2/181 |

* cited by examiner

*Primary Examiner*—Katherine Moran
(74) *Attorney, Agent, or Firm*—Arthur Jacob

(57) ABSTRACT

A self-sizing cap provides a secure, optimum fit upon a wearer's head over a range of sizes. The cap includes a crown and a headband in the form of a plurality of headband segments extending circumferentially along the lower peripheral edge of the crown of the cap. A first headband segment is located along a back portion of the crown and is constructed of a uniaxially resiliently stretchable material oriented for stretching along circumferential directions. A second headband segment is constructed of a substantially non-stretchable material, preferably a perspiration-absorbing material, and is located along a front portion of the crown. Third headband segments are located along side portions of the crown, placed between the first and second headband segments, and are constructed of a biaxially resiliently stretchable material. The diverse characteristics of the headband segments, together with the specific locations and extent of the particular headband segments, accomplish a secure and comfortable fit with increased ease while providing an authentic aesthetic appearance that mimics a custom-fitted cap.

15 Claims, 3 Drawing Sheets

SELF-SIZING CAP WITH DIVERSE HEADBAND SEGMENTS

The present invention relates generally to a cap constructed for fitting a range of sizes and pertains, more specifically, to a self-sizing cap having a headband provided with sections of diverse characteristics selected for enabling a wearer to attain an optimum fit and greater comfort with increased ease.

Over the years, the baseball-style cap essentially has become a staple item of apparel, put into everyday use by a wide variety of wearers as casual wear, as well as work related wear, and during recreational pursuits. As a result of a continued strong and widespread demand for such caps, a great deal of effort has been directed toward developing an aesthetically pleasing, high-performance yet economical construction which is capable of accommodating a range of sizes without sacrificing the look and feel heretofore found only in a custom-fitted cap created for a single size and fit. While many attempts have been directed toward that end, with some success in meeting the need to self-adjust for accommodating a particular size within a limited range of sizes, current baseball style cap designs fall short in providing ease of donning, together with a secure and comfortable fit, while still maintaining the basic aesthetic appearance of a custom-fitted cap.

The present invention takes into account the manner in which a wearer puts on a baseball style cap, as well as how the cap is worn after it is fitted to a wearer's head, to provide an easily donned cap with a more comfortable and secure fit. As such, the present invention attains several objects and advantages, some of which are summarized as follows: Provides a baseball style cap construction capable of accommodating a range of sizes to attain a secure, comfortable fit with increased ease; enables a wearer to put on a self-sizing baseball style cap and attain a better, more comfortable and secure fit with increased ease and confidence, over a range of sizes; maintains the aesthetic appearance of a custom-fitted baseball style cap while accommodating a range of sizes without requiring undue extraneous adjustments for optimizing fit and feel; self-adjusts to a particular size while establishing a secure and comfortable fit without requiring departure from a conventional procedure in putting on a baseball style cap; enhances the performance of a self-sizing baseball style cap by enabling the absorption of perspiration without sacrificing the ability to adjust to a particular size, with comfort and security; facilitates fitting a self-adjusting baseball style cap to a wearer's head to attain a more comfortable and secure placement with increased ease and greater assurance; enhances the performance of a self-adjusting baseball style cap with a relatively simple and economical improvement in construction; combines economy of manufacture with a high degree of satisfaction in the field for promoting widespread adoption and use; more faithfully mimics a custom-fitted cap, in both appearance and performance, while providing the economy associated with a construction which accommodates a range of sizes; provides a self-sizing baseball style cap of rugged construction capable of exceptional performance over an extended service life.

The above objects and advantages, as well as further objects and advantages, are attained by the present invention which may be described briefly as a self-sizing cap for providing a secure, optimum fit upon a wearer's head over a range of sizes, the cap comprising: a crown reaching from an apex to a lower peripheral edge extending circumferentially around the crown, the crown having a front portion, a back portion diametrically opposite the front portion, and laterally opposite side portions extending between the front portion and the back portion of the crown; and a plurality of headband segments extending in circumferential directions along the lower peripheral edge of the crown, the plurality of headband segments including: a first headband segment located along the back portion of the crown, the first headband segment being constructed of a uniaxially resiliently stretchable material oriented for stretching resiliently along the circumferential directions; a second headband segment located along the front portion of the crown, the second headband segment being constructed of a substantially non-stretchable material; and third headband segments constructed of a biaxially resiliently stretchable material, each third headband segment being located along a corresponding side portion of the crown and extending between the first headband segment and the second headband segment.

The present invention will be understood more fully, while still further objects and advantages will become apparent, in the following detailed description of preferred embodiments of the invention illustrated in the accompanying drawing, in which.

Figure 1:
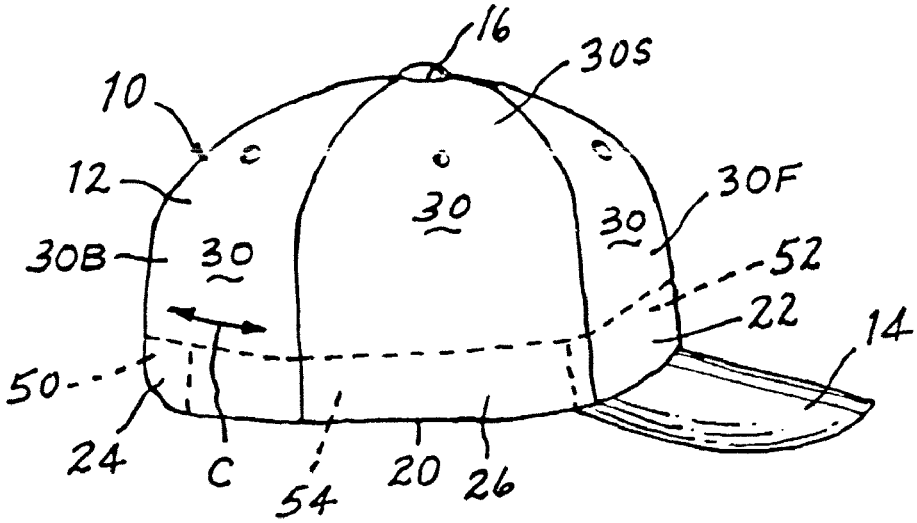
FIG. 1 is a side elevational view of a self-sizing baseball style cap constructed in accordance with the present invention.

Referring now to the drawing, and especially to FIG. 1 thereof, a self-sizing cap constructed in accordance with the present invention is shown in the form of a baseball style cap 10 having a crown 12 and a visor 14. Crown 12 has a generally dome-shaped configuration reaching from an apex 16 to a lower peripheral edge 20 extending circumferentially around the crown 12. Visor 14 is joined to the crown 12 along a front portion 22 of the crown 12 and crown 12 includes a back portion 24 diametrically opposite front portion 22, and laterally opposite side portions 26 extending between the front portion 22 and the back portion 24.

Crown 12 is comprised of a plurality of gores 30 arrayed and assembled in a now well-known manner to construct the dome-shaped configuration of baseball style cap 10. In the illustrated embodiment, six gores 30 make up the crown 12 and include two generally front-facing gores 30F, two generally back-facing gores 30B, and two generally side-facing gores 30S (see also FIG. 4). Gores 30F which preferably are relatively stiff so that, together with attached visor 14, which itself is semi-rigid, cap 10 presents at least a well-defined semi-domed shape at the front of the cap 10. As is conventional in currently available caps of the type which self-adjust over a range of sizes to fit a particular wearer's head, side gores 30S and back gores 30B are constructed of a uniaxially resiliently stretchable material which enables gores 30S and 30B to stretch resiliently in circumferential directions C so as to conform cap 10 to a particular size within a range of sizes, and to do so automatically, upon donning cap 10, without requiring the use of supplemental adjustment mechanisms, such as straps and fasteners, in order to arrive at a suitable size. Thus, crown 12 can be expanded, with a concomitant expansion along lower peripheral edge 20, to adjust to a desired size within the range of sizes, while maintaining, with greater authenticity, the aesthetic appearance of a custom-fitted cap.

Figure 2:
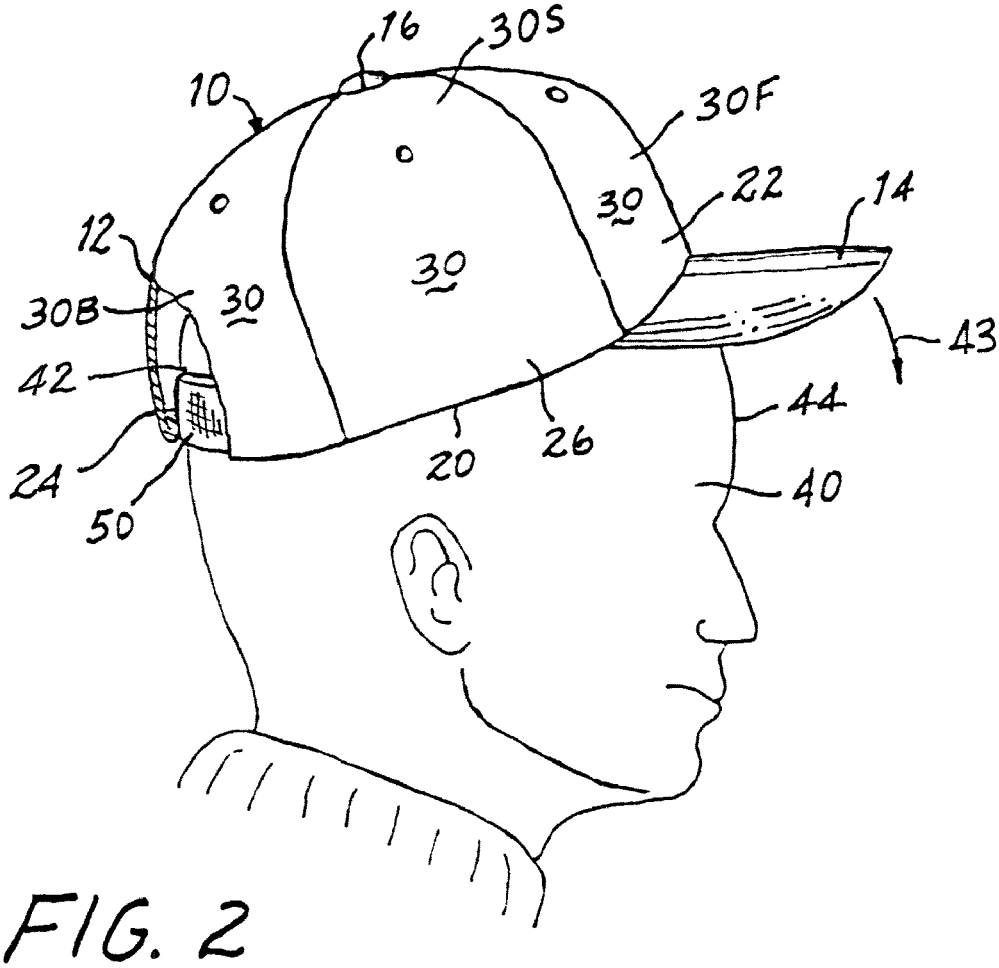
FIG. 2 is an enlarged, largely diagrammatic view depicting a stage in the procedure for placement of the cap on the head of a wearer.
Figure 3:
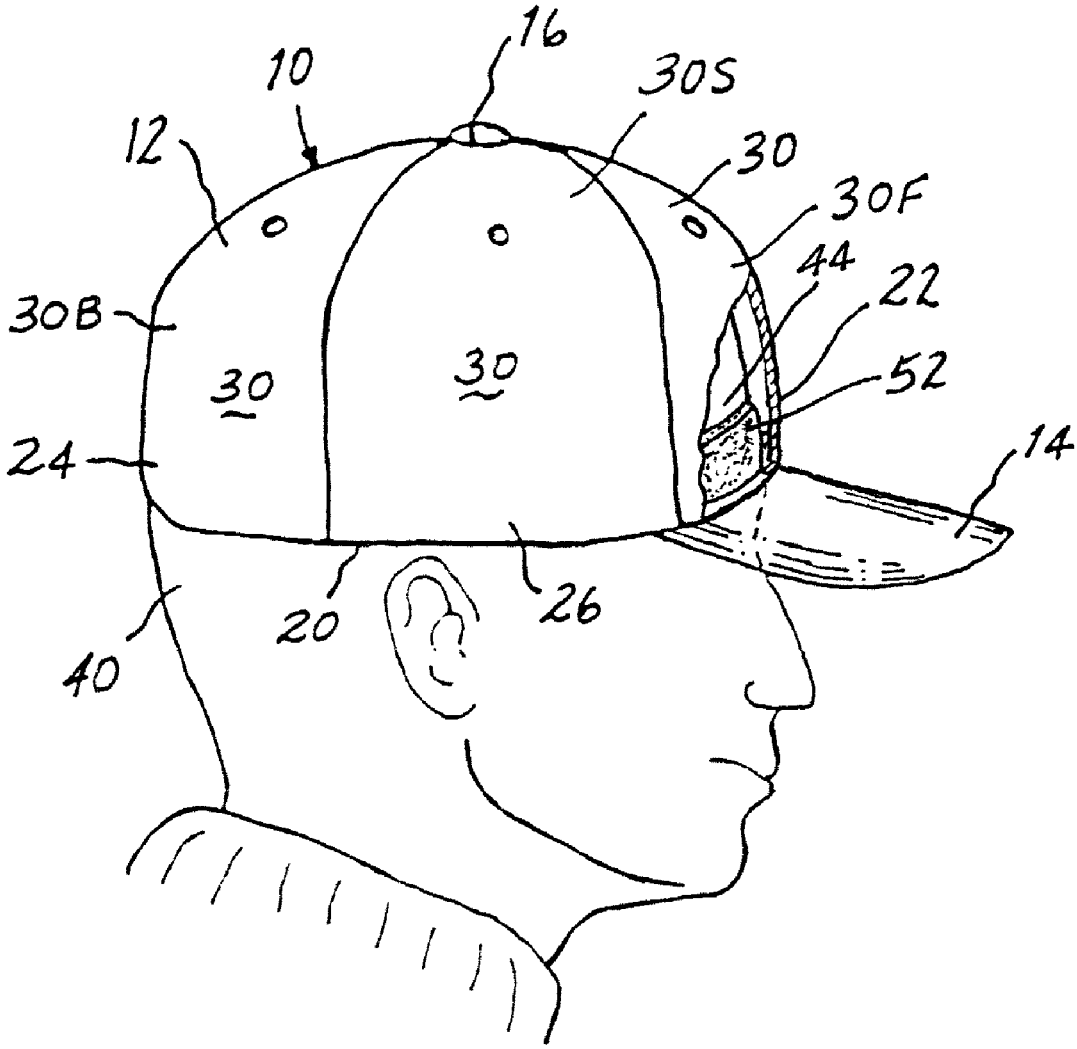
FIG. 3 is a view similar to FIG. 2 and depicting the cap in place on the head of the wearer.

Typically, a baseball style cap is slipped onto a wearer's head by the wearer grasping the visor of the cap, placing the back of the cap against the back of the wearer's head, and then pulling the visor 14 down until the front of the cap is moved downwardly and the cap is fully in place on the wearer's head. Thus, as illustrated somewhat diagrammatically in FIGS. 2 and 3, wherein cap 10 is shown being put in place on a wearer's head 40, first the back portion 24 of the crown 12 is engaged with the back 42 of the wearer's head 40, as seen in FIG. 2. Then, the cap 10 is pulled down and somewhat forward, in the direction of arrow 43 in FIG. 2, to seat the crown 12 and, consequently, cap 10 fully in place upon the wearer's head 40, with visor 14 located in juxtaposition with the wearer's forehead 44, as shown in FIG. 3.

Figure 4:
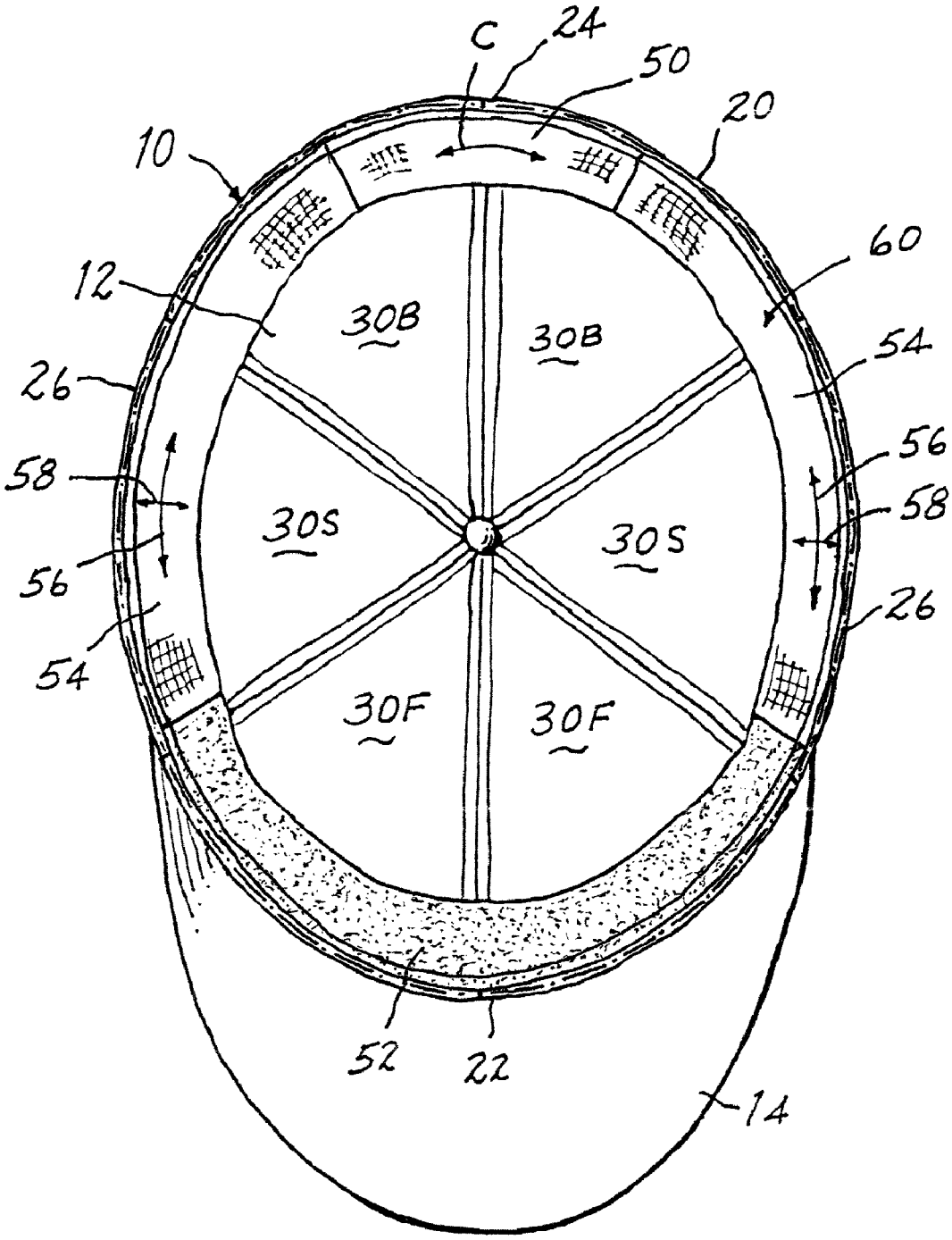
FIG. 4 is a further enlarged bottom plan view of the cap.

In order to accommodate the aforesaid procedure and establish a secure and optimum fit which is both comfortable and aesthetically as pleasing as that furnished by a custom-fitted cap, cap 10 is provided with headband segments of diverse characteristics selected for assuring the attainment of the desired fit and feel while preserving the ability to don cap 10 in the above-described conventional manner. Turning now to FIG. 4, a first headband segment 50 is juxtaposed with the back portion 24 of the crown 12, extending along the lower peripheral edge 20 and secured to the crown 12 in a conventional manner. First headband segment 50 is constructed of a uniaxially resiliently stretchable material oriented for stretching resiliently in the circumferential directions C. A second headband segment 52 is juxtaposed with the front portion 22 of the crown 12, extending along the lower peripheral edge 20 and secured to the crown 12 adjacent the visor 14. Second headband segment 52 is constructed of a substantially non-stretchable material, preferably chosen from among those materials which can absorb perspiration, such as cotton. Third headband segments 54 are constructed of a biaxially resiliently stretchable material, each third headband segment 54 being juxtaposed with a corresponding side portion 26 of the crown 12, extending along the lower peripheral edge 20 between the first headband segment 50 and the second headband segment 52, and affixed to the crown 12. Preferably, the material of third headband segments 54 is oriented for stretching resiliently along a first direction 56 aligned with the circumferential directions C, and a second direction 58 substantially perpendicular to the first direction 56.

The diverse characteristics of the first, second and third headband segments 50, 52 and 54, together with the location and extent of each headband segment 50, 52 and 54, enable the headband segments to operate in concert to facilitate putting on cap 10 in the manner described above in connection with FIGS. 2 and 3. Thus, upon engagement of the back portion 24 of crown 12 with the back 42 of the wearer's head 40, as seen in FIG. 2, first headband segment 50 will assure a secure purchase in place on the wearer's head 40, the uniaxial stretchability of the material of first headband segment 50 facilitating the establishment of an appropriate fit against the wearer's head 40 while inhibiting stretching in directions transverse to circumferential directions C so as to resist distortion and possible dislodging of the back portion 24 as the cap 10 is moved toward the fully-seated position illustrated in FIG. 3.

As the cap 10 is moved toward the fully-seated position, the biaxial stretchability of the third headband segments 54 facilitates conformance of the crown 12 to the contours of the wearer's head 40 and the arrival of the cap 10 at the fully-seated position. Once at the fully-seated position, the cap 10 is secured in place by the biasing forces exerted uniaxially by the first headband segment 50 and biaxially by the third headband segments 54 operating in concert with resistive forces provided by the substantially non-stretchable second headband segment 52. At the same time, the biaxial stretch characteristics of the third headband segments 54 assures proper alignment of the side and back gores 30S and 30B for maintaining a comfortable fit and an aesthetic appearance associated with a custom fit cap. Further, the second headband segment 52 is biased against the wearer's forehead 44 for absorbing perspiration which otherwise could run down to the wearer's eyes.

In the preferred construction, each third headband segment 54 is contiguous with the first and second headband segments 50 and 52 so that the headband segments are arranged as sections of a headband length that extends along the entire circumferential length of the lower peripheral edge 20. By integrating the headband segments 50, 52 and 54 into sections of an essentially continuous headband construct 60, an optimum fit is provided while promoting comfort and securement of cap 10 to the wearer's head 40. In the preferred arrangement of the headband construct 60, the first headband segment occupies about twelve percent of a full 360° headband length, the second headband segment 52 occupies about thirty-three percent of the headband length, and each third headband segment occupies about twenty-seven and one-half percent of the headband length. These proportions have been found to furnish cap 10 with exemplary performance combined with a high degree of aesthetic appeal.

It will be seen that the present invention attains all of the objects and advantages summarized above, namely: Provides a baseball style cap construction capable of accommodating a range of sizes to attain a secure, comfortable fit with increased ease; enables a wearer to put on a self-sizing baseball style cap and attain a better, more comfortable and secure fit with increased ease and confidence, over a range of sizes; maintains the aesthetic appearance of a custom-fitted baseball style cap while accommodating a range of sizes without requiring undue extraneous adjustments for optimizing fit and feel; self-adjusts to a particular size while establishing a secure and comfortable fit without requiring departure from a conventional procedure in putting on a baseball style cap; enhances the performance of a self-sizing baseball style cap by enabling the absorption of perspiration without sacrificing the ability to adjust to a particular size, with comfort and security; facilitates fitting a self-adjusting baseball style cap to a wearer's head to attain a more comfortable and secure placement with increased ease and greater assurance; enhances the performance of a self-adjusting baseball style cap with a relatively simple and economical improvement in construction; combines economy of manufacture with a high degree of satisfaction in the field for promoting widespread adoption and use; more faithfully mimics a custom-fitted cap, in both appearance and performance, while providing the economy associated with a construction which accommodates a range of sizes; provides a self-sizing baseball style cap of rugged construction capable of exceptional performance over an extended service life.

It is to be understood that the above detailed description of preferred embodiments of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A self-sizing cap for providing a secure, optimum fit upon a wearer's head over a range of sizes, the cap comprising:

a crown reaching from an apex to a lower peripheral edge extending circumferentially around the crown, the crown having a front portion, a back portion diametrically opposite the front portion, and laterally opposite side portions extending between the front portion and the back portion of the crown; and a plurality of headband segments extending in circumferential directions along the lower peripheral edge of the crown, the plurality of headband segments including:

a first headband segment located along the back portion of the crown, the first headband segment being constructed of a uniaxially resiliently stretchable material oriented for stretching resiliently only along a direction aligned substantially with the circumferential directions;

a second headband segment located along the front portion of the crown, the second headband segment being constructed of a substantially non-stretchable material; and third headband segments constructed of a biaxially resiliently stretchable material for stretching resiliently along two directions, each third headband segment being located along a corresponding side portion of the crown and extending between the first headband segment and the second headband segment.

2. The self-sizing cap of claim 1 wherein the material of the third headband segments is oriented for stretching resiliently along a first direction aligned with the circumferential directions, and a second direction substantially perpendicular to the first direction.

3. The self-sizing cap of claim 2 wherein the material of the second headband segment comprises a perspiration-absorbing material.

4. The self-sizing cap of claim 3 wherein the material of the second headband segment comprises cotton.

5. The self-sizing cap of claim 1 wherein the crown is comprised of a plurality of gores arrayed circumferentially around the crown and extending from the apex to the lower peripheral edge of the crown, at least some of the gores being constructed of a uniaxially resiliently stretchable material oriented for stretching resiliently along the circumferential directions, the at least some of the gores being placed within the crown so as to be juxtaposed with corresponding first and third headband segments.

6. The self-sizing cap of claim 1 including a visor joined with the crown along the front portion of the crown, the second headband segment being juxtaposed with the visor.

7. The self-sizing cap of claim 1 wherein the lower peripheral edge of the crown has a circumferential length extending fully around the crown, and the third headband segments are contiguous with the first and second headband segments such that the first, second and third headband segments are integrated into a headband length, the headband length corresponding to and extending along the entire circumferential length of the lower peripheral edge of the crown.

8. The self-sizing cap of claim 7 wherein the first headband segment extends along about twelve percent of the headband length.

9. The self-sizing cap of claim 7 wherein the second headband segment extends along about thirty-three percent of the headband length.

10. The self-sizing cap of claim 7 wherein each third headband segment extends along about twenty-seven and one-half percent of the headband length.

11. The self-sizing cap of claim 7 wherein the first headband segment extends along about twelve percent of the headband length, the second headband segment extends along about thirty-three percent of the headband length, and each third headband segment extends along about twenty-seven and one-half percent of the headband length.

12. The self-sizing cap of claim 11 wherein the crown is comprised of a plurality of gores arrayed circumferentially around the crown and extending from the apex to the lower peripheral edge of the crown, at least some of the gores being constructed of a uniaxially resiliently stretchable material oriented for stretching resiliently along the circumferential directions, the at least some of the gores being placed within the crown so as to be juxtaposed with corresponding first and third headband segments.

13. The self-sizing cap of claim 12 wherein the material of the second headband segment comprises a perspiration-absorbing material.

14. The self-sizing cap of claim 13 wherein the material of the second headband segment comprises cotton.

15. The self-sizing cap of claim 14 including a visor joined with the crown along the front portion of the crown, the second headband segment being juxtaposed with the visor.

* * * * *